US006670780B2

(12) United States Patent
Ono et al.

(10) Patent No.: US 6,670,780 B2
(45) Date of Patent: Dec. 30, 2003

(54) METHOD FOR OPERATING HIGH-PRESSURE DISCHARGE LAMP, LIGHTING APPARATUS, AND HIGH-PRESSURE DISCHARGE LAMP APPARATUS

(75) Inventors: Shunsuke Ono, Takatsuki (JP); Masahiro Yamamoto, Takatsuki (JP); Minoru Ozasa, Kyoto (JP); Masato Yoshida, Takatsuki (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 0 days.

(21) Appl. No.: 10/278,207

(22) Filed: Oct. 21, 2002

(65) Prior Publication Data

US 2003/0080693 A1 May 1, 2003

(30) Foreign Application Priority Data

Oct. 26, 2001 (JP) ..... 2001-329874

(51) Int. Cl.[7] ..... G05F 1/00

(52) U.S. Cl. ..... 315/291; 315/307; 315/224; 315/362; 315/174

(58) Field of Search ..... 315/307, 291, 315/209 R, 247, 224, 360, 362, 128, DIG. 7, 82, 174, 175

(56) References Cited

U.S. PATENT DOCUMENTS 5,491,386 A * 2/1996 Eriguchi et al. ..... 315/209 R
6,005,356 A * 12/1999 Horiuchi et al. ..... 315/307
6,127,789 A * 10/2000 Ishizuka et al. ..... 315/308
6,215,254 B1 * 4/2001 Honda et al. ..... 315/246
6,545,430 B2 * 4/2003 Ono et al. ..... 315/291

* cited by examiner

*Primary Examiner*—Haissa Philogene

(57) ABSTRACT

Disclosed is a method for operating a high-pressure discharge lamp, a lighting apparatus, and a high-pressure discharge lamp apparatus each capable of operating the lamp at a power lower than the rated power without imposing excessive burden on the lighting circuit. To this end, when a detected lamp voltage (Vla) is below a predetermined level (S102: No), the current is supplied at a lower frequency than the rated frequency for a predetermined time period (S103 and S104 ).

28 Claims, 8 Drawing Sheets

FIG.7

| Frequency (Hz) | Average Change in Lamp Voltage (△Vla) | State of Electrodes |
|---|---|---|
| 0.05 | +32.4 | Protrusions Completely Disappeared |
| 0.1 | +20.3 | Protrusions Partly Disappeared/Completely Disappeared in One of Samples (1/5) |
| 0.5 | +12.4 | Protrusions Partly Disappeared |
| 1 | + 5.9 | Protrusions Partly Disappeared |
| 5 | + 1.9 | Protrusions Partly Disappeared/No Change in One of Samples (1/5) |
| 10 | + 0.7 | Protrusions Partly Disappeared/No Change in Some of Samples (3/5) |
| 20 | + 0.1 | No Change |

FIG.8

| Frequency (Hz) | Cycle | Change in Lamp Voltage (V) | Flicker |
|---|---|---|---|
| 0.5 | 0.5 | ① 5.4 | ○ |
| | | ② 7.2 | △ |
| | 1 | ① 13.6 | △ |
| | | ② 12.1 | △ |
| | 5 | ① 13.3 | × |
| | | ② 13.7 | × |
| | 10 | ① 11.5 | × |
| | | ② 12.5 | × |
| | 20 | ① 13.5 | × |
| | | ② 12.3 | × |
| 1 | 0.5 | ① 4.5 | ○ |
| | | ② 3.9 | ○ |
| | 1 | ① 6.6 | ○ |
| | | ② 7.6 | ○ |
| | 5 | ① 9.3 | △ |
| | | ② 7.0 | △ |
| | 10 | ① 8.4 | △ |
| | | ② 6.0 | × |
| | 20 | ① 5.2 | × |
| | | ② 8.5 | × |
| 5 | 0.5 | ① 0.0 | ○ |
| | | ② 0.7 | ○ |
| | 1 | ① 1.8 | ○ |
| | | ② 2.1 | ○ |
| | 5 | ① 1.4 | ○ |
| | | ② 0.0 | ○ |
| | 10 | ① 1.6 | △ |
| | | ② 2.0 | △ |
| | 20 | ① 2.2 | × |
| | | ② 1.5 | × |

METHOD FOR OPERATING HIGH-PRESSURE DISCHARGE LAMP, LIGHTING APPARATUS, AND HIGH-PRESSURE DISCHARGE LAMP APPARATUS

This application is based on a patent application No. 2001-329874 filed in Japan, the content of which is hereby incorporated by reference.

BACKGROUND OF THE INVENTION

1. Field of the Invention

The present invention relates to a method for operating a high-pressure discharge lamp, a lighting apparatus, and a high-pressure discharge lamp apparatus.

2. Description of Related Art

Light sources generally in use for a liquid crystal projector are high-pressure discharge lamps such as high-pressure mercury lamps. As liquid crystal projectors are reduced in size and more widely used in a general household environment, it is now required to make some adjustment depending on brightness of the environment and the type of image to be projected so as to prevent the screen from being too bright. One liquid crystal projector designed to meet such requirement has a so-called dimming control function (See, for example JP 2000-131668-A). The dimming control is achieved by operating a high-pressure discharge lamp at a lower power than the rated power with the aim to adjust the brightness of lamp as well as to save power consumption.

However, the inventors of the present invention have made study on the impact of the dimming control on a conventional high-pressure discharge lamp and a conventional lighting circuit, and found a problem as follows. That is, a lighting apparatus exhibits a greater rise in the temperature in comparison with when operated at the rated power. This greater temperature rise is ascribable to excessive burden imposed on the lighting apparatus, and means that the lighting apparatus needs to be upsized and/or provided with enhanced cooling. These requirements, however, contradict a demand for a downsized, quieter projector.

SUMMARY OF THE INVENTION

An object of the present invention is to provide a method for operating a high-pressure discharge lamp, a lighting apparatus, and a high-pressure discharge lamp apparatus each capable of preventing the lighting apparatus from excessive burden even when the high-pressure discharge lamp is operated at a lower power than its rated power.

The object of the present invention stated above is achieved by a method for operating a high-pressure discharge lamp by supplying an alternating current thereto. The high-pressure discharge lamp has an arc tube in which a halogen material is sealed and a pair of electrodes is provided. The method includes: a voltage decrease detecting step of detecting that a voltage across the pair of electrodes has decreased below a predetermined level; and a low frequency current supplying step of supplying the alternating current at a lower frequency than a rated frequency for a predetermined time period. The low frequency current supplying step is performed when the voltage decrease is detected in the voltage decrease detecting step.

With this construction, even if protrusions each formed at the top of electrode grow abnormally as a result of, for example, dimming control, the protrusions are made to partly disappear so that the protrusions are reduced to a suitable size. Thus, an excessive temperature rise in the lighting apparatus is suppressed. The present invention is applicable to a DC type high-pressure discharge lamp as well as to an AC type. That is, according to the detection in the voltage decrease detection step, the direction of the direct current is reversed for a predetermined time period.

Alternatively, the object of the present invention stated above is achieved by a lighting apparatus for operating a high-pressure discharge lamp by supplying an alternative current thereto. The high-pressure discharge lamp has an arc tube in which a halogen material is sealed and a pair of electrodes is provided. The lighting apparatus includes: a voltage detector for detecting a voltage across the pair of electrodes; and a controller for controlling the alternating current so that, when the voltage detected by the voltage detector decreases below a predetermined level, the alternating current is supplied at a lower frequency than a rated frequency for a predetermined time period.

When a DC type high-pressure discharge lamp is employed, it is achieved by a lighting apparatus for operating a high-pressure discharge lamp by supplying a direct current thereto. The high-pressure discharge lamp has an arc tube in which a halogen material is sealed and a pair of electrodes is provided. The lighting apparatus includes: a voltage detector for detecting a voltage across the pair of electrodes; and a controller for controlling the direct current so that, when the voltage detected by the voltage detector decreases below a predetermined level, the direct current flows in a reversed direction for a predetermined time period.

Alternatively, the object of the present invention is achieved by a high-pressure discharge lamp apparatus including: a high-pressure discharge lamp having an arc tube in which a halogen material is sealed and a pair of electrode is provided; and a lighting apparatus for operating the high-pressure discharge lamp by supplying an alternating current thereto. The lighting apparatus includes: a voltage detector for detecting a voltage across the pair of electrodes; and a controller for controlling the alternating current so that, when the voltage detected by the voltage detector decreases below a predetermined level, the alternating current is supplied at a lower frequency than a rated frequency for a predetermined time period.

Specific examples of a high-pressure discharge lamp apparatus include various projectors, such as a liquid crystal projector, using a high-pressure discharge lamp as its light source. In addition, the examples include a general-use lighting apparatus, a headlight for a vehicle, a lighting apparatus for medical application, a curing apparatus for ultraviolet curable resin.

A high-pressure discharge lamp apparatus according to the present invention may have a socket unit for attaching a high-pressure discharge lamp but without a high-pressure discharge lamp itself (Examples of such include a projector to which a high-pressure discharge lamp is not yet attached).

Further, a high-pressure discharge lamp apparatus according to the present invention may have a high-pressure discharge lamp that is directly connected to a lighting apparatus without employing a socket unit.

When a DC type high-pressure discharge lamp is employed, the object of the present invention is achieved by the above lighting apparatus for a DC type high-pressure discharge lamp.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings:

FIG. 7 is a view showing the result of actual experiment conducted for the study of the frequency under the low-frequency supplying control; and FIG. 8 is a view showing the result of actual experiment conducted for the study of the number of cycles of a low frequency current supplied under the low-frequency supplying control.

DESCRIPTION OF THE PREFERRED EMBODIMENT

Hereinafter, description is given to a method of operating a high-pressure discharge lamp as an embodiment of the present invention with reference to the accompanying drawings.

(1) Construction of High-pressure Discharge Lamp

Figure 1:
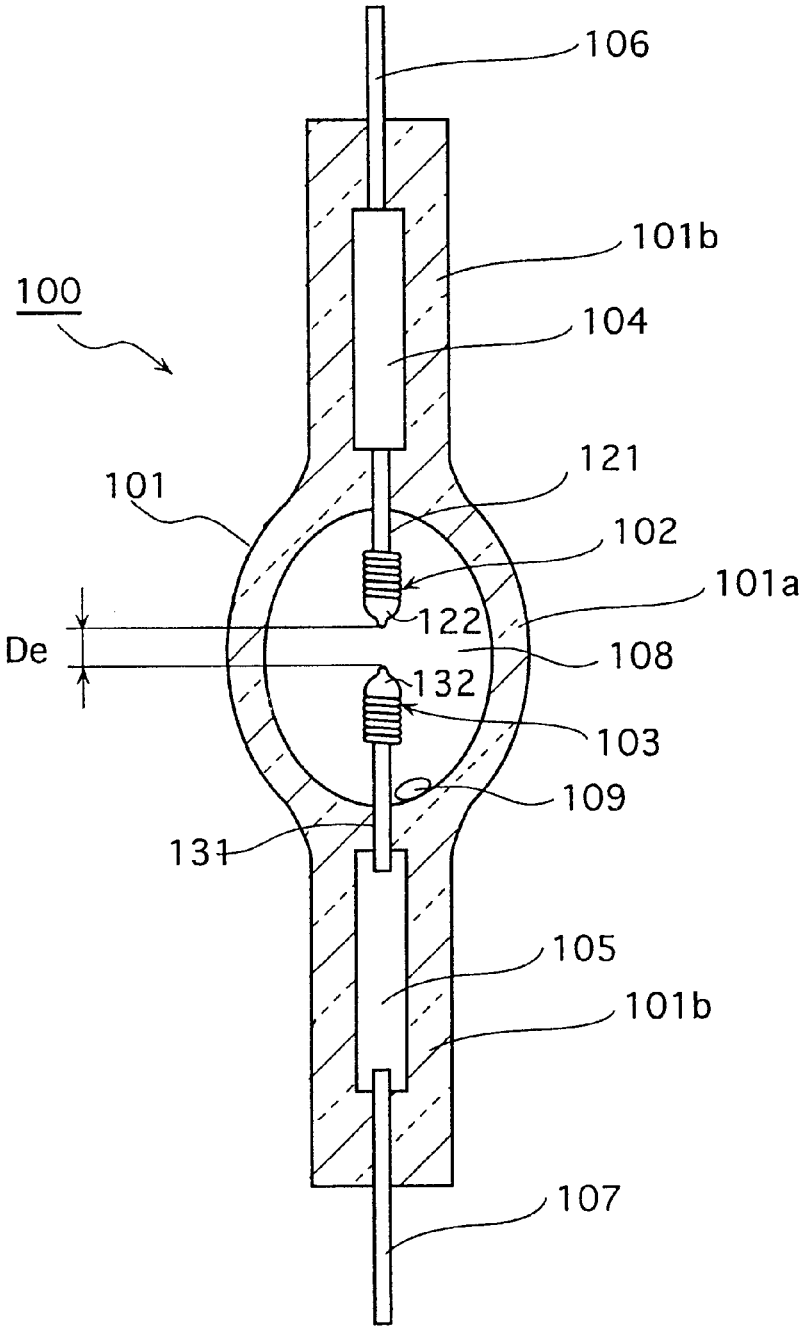
FIG. 1 is a sectional view showing the construction of a high-pressure mercury lamp 100 according to an embodiment of the present invention.

FIG. 1 is a view showing the construction of a high-pressure mercury lamp 100 of which rated power is 150 W, as one example of a high-pressure discharge lamp. For the sake of convenience, the figure is a sectional view taken along a part where electrodes are exposed.

As shown in the figure, the high-pressure mercury lamp 100 is composed of an arc tube 101 made of quarts glass. The arc tube 101 has a lighting portion 101*a* of spheroidal shape, and a sealing portion 101*b* formed at each end of the lighting portion 101*a*. The lighting portion 101*a* is internally provided with a pair of tungsten electrodes 102 and 103. The sealing portions 101*b* are internally provided with molybdenum foils 104 and 105 sealed therein, respectively, and the molybdenum foils 104 and 105 are connected to the pair of the tungsten electrodes 102 and 103, respectively. The molybdenum foils 104 and 105 at the other ends are connected to outer molybdenum lead wires 106 and 107, respectively.

The distance between the tips of the tungsten electrodes 102 and 103, i.e., the interelectrode distance De is set within the range of 0.5–2.0 mm. Note that when completed as a finished product, the high-pressure mercury lamp 100 in this embodiment has a protrusion of a certain size formed at the tip of each of the tungsten electrodes 102 and 103. Thus, this 0.5–2.0 mm range preferably determines the distance between the electrodes each having such a protrusion formed at the tip.

Sealed in a lighting space 108 formed inside the lighting portion 101*a* are mercury 109 as a light-emitting material, and inert gas, such as argon (Ar), krypton (Kr), and xenon (Xe), as a starting-up aid, along with a halogen material, such as iodine (I) and bromine (Br). In this case, the sealing amount of the mercury 109 is set within the range of 150–650 mg/cm$^3$ of capacity of the lighting space 108 (which is equivalent to the pressure of approximately 15–65 MPa at the rated operation of the lamp). Further, the pressure of the inert gas when the lamp is under cooled state is set within the range of 0.01–1 MPa.

As in a conventional practice, the halogen material is Br in the amount within the range of $1\times10^{-10}$ mol/cm$^3$ and $1\times10^{-4}$ mol/cm$^3$. The halogen material is sealed in order to achieve a so-called halogen cycle in which evaporated tungsten returns back to the electrodes so that blackening of the arc tube is suppressed. To achieve the maximum effect of halogen cycle, it is especially preferable that the amount of Br sealed is within the range of $1\times10^{-9}$ mol/cm$^3$ and $1\times10^{-5}$ mol/cm$^3$ inclusive.

Figure 2:
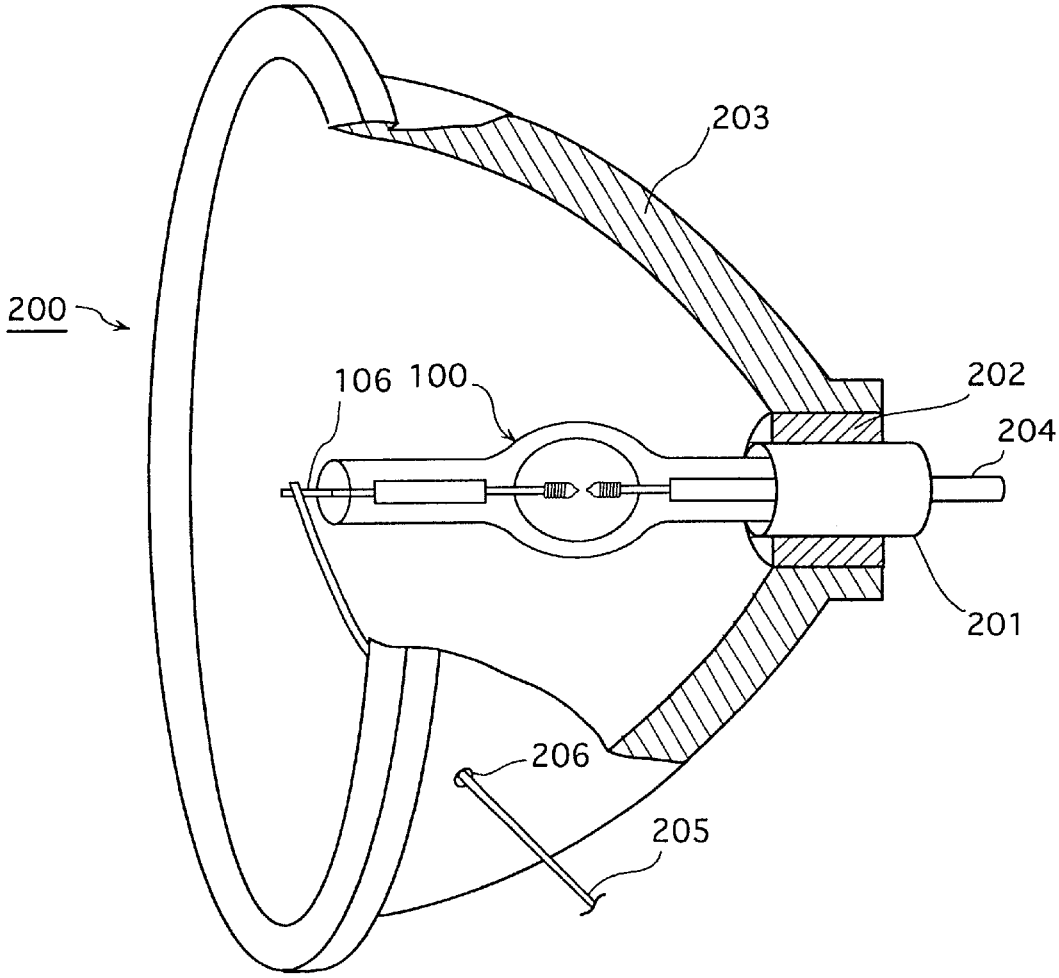
FIG. 2 is a partly-broken oblique view showing the construction of a lump unit 200 into which the high-pressure mercury lamp 100 is incorporated.

FIG. 2 is a partly-broken oblique view showing the construction of a lump unit 200 into which the above high-pressure mercury lamp 100 is incorporated. As shown in the figure, the lamp unit 200 is so constructed that the a base 201 is attached to one end of the arc tube 101, and the arc tube 101 is attached to a reflecting mirror 203 via a spacer 202 in a state that the arc axis coincides with the optical axis of the reflecting mirror 203. The two electrodes of the high mercury lamp 100 are so constructed that an electric current is supplied to the electrodes via a terminal 204 and a lead wire 205, respectively. The lead wire 205 extends outside the reflecting mirror 203 through a hole 206 that is formed through the reflecting mirror 203.

(2) Developments Leading to Present Invention

Prior to more concrete description of the embodiment, description is given to developments that lead to the present invention.

Figure 3:
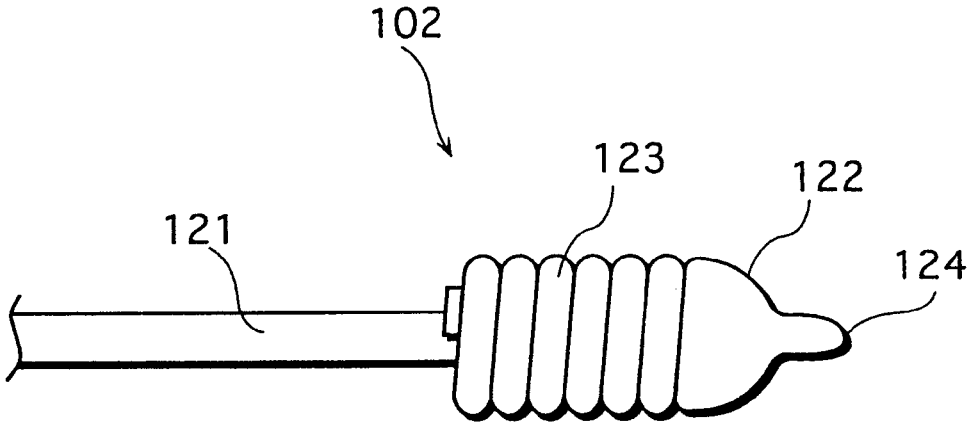
FIG. 3 is a view illustrating abnormal growth of a protrusion 124 at the tip of an electrode.

First, the inventors of the present invention have assumed that the excessive temperature rise in the lighting apparatus as described above is caused because the lighting circuit inevitably operates under the conditions that the lighting circuit is not designed to be ready for. Then, the study has been conducted to clarify causes of such conditions. The inventors of the present invention have come to note that in the case where the dimming control is effected, a protrusion 124 has abnormally grown at the tip of each electrode, as shown in FIG. 3.

Considering the cause of such an abnormally grown protrusion, the inventors of the present invention have arrived at the following assumption. According to the assumption, when a high-pressure discharge lamp is operated at the rated power, the following mechanism works. That is, the tungsten forming the electrodes evaporates due to the heat generated at the time of lamp operation, and deposits itself onto the inner wall of the arc tube, thereby causing blackening of the arc tube. The halogen material sealed in the arc tube serves to promote the halogen cycle that suppresses the above blackening problem. In the presence of the halogen material, the vaporized tungsten is chemically combined with the halogen, and the compound moves back by convection to the arc plasma where the tungsten is dissociated from the halogen. Having positively ionized, the tungsten is attracted to, and accumulated in the region around the arc spot where the electric fields converge at the tip of the electrode in the negative phase. When the electrode reverses to the positive phase, electrons collide against the entire tip of the electrode, thereby raising the temperature. As a result, the tungsten accumulated when the electrode is in the negative phase evaporates again.

When the high-pressure discharge lamp is operated at the rated power, the above accumulation and evaporation are stably balanced at a level keeping the protrusions at the tip of each electrode within an appropriate size. However, when the dimming control is effected, i.e., when the lamp is operated at a lower power than the rated power, the temperature at the tip of the electrode in the positive phase is lower in comparison with when the lamp is operated at the rated power. Due to this lower temperature, a fewer amount of the tungsten evaporates, so that the balance between the accumulation and evaporation is disturbed. Eventually, the tungsten is stabilized under the state being locally accumulated at the tip of each electrode. This causes the abnormal growth of the protrusions.

Such abnormally grown protrusions equally mean the shorter arc length. That is, the voltage across the pair of electrodes (the lamp voltage Vla) decreases, so that the current supplied to the high-pressure discharge lamp increases under the constant-power control effected by the lighting circuit. This increase in the supplied current exceeds the level expected for the rated power operation, and thus causes the excessive increase in the temperature. As described above, the inventors of the present invention have clarified the cause of the excessive temperature rise in the lighting circuit, and further conducted extensive study for the means to solve the above problems to arrive at the method for operating a high-pressure discharge lamp and the other techniques according to the present invention.

That is to say, the method for operating a high-pressure discharge lamp according to the present invention is a method for operating a high-pressure discharge lamp by supplying an alternating current thereto. Here, the lamp has an arc tube in which a halogen material is sealed and a pair of electrodes is provided. According to the method, when the voltage across the pair of electrodes decreases below a predetermined level due to the change in the interelectrode distance during the lamp operation, the alternating current is supplied at a lower frequency than the rated frequency for a predetermined time period.

The rated frequency used herein refers to the frequency of the alternating current supplied to the high-pressure discharge lamp at the rated power operation. The duration of the time period is mainly determined by the frequency and the number of cycles of the alternating current to be supplied. The present invention achieves to suppress the temperature rise in the lighting apparatus, because the provision of the above time period leads to the temperature rise at the tip of each electrode, and thus the protrusion formed at the tip of each electrode disappears partly, i.e., each protrusion is reduced to a suitable size. Accordingly, the arc length is lengthened so that the lamp voltage Vla rises. In view of the above mechanism, the inventors of the present invention have further conducted study to clarify that the frequency of the alternating current supplied during the above time period preferably falls within the range of 0.1–10 Hz inclusive. Note that, however, the frequency is not limited to the above range, and may be optimized depending on various factors, such as the structure of the lamp, the material sealed in the arc tube, the electrode material, and the shape or the structure of the electrodes.

Further, the inventors of the present invention have also clarified that the number of cycles to be supplied is preferably 10 cycles or less in view of the impact on occurrences of flicker during the lamp operation. Similarly to the above frequency, it should be noted that the number of cycles to be supplied is not limited to the above specific values, and may be optimized depending on various factors. Further, the frequency is not necessarily constant throughout the above time period, and may be varied in a continuous manner. Alternatively, it may be applicable to supply the low frequency current intermittently.

Preferably, at least one cycle is supplied during the time period. This is because by supplying the low frequency for one cycle, both protrusions grown on each of the pair of the electrodes are made smaller to the same extent. Here, when the low frequency is started to be supplied at the phase of 0°, one cycle may be sufficient. However, when the lighting circuit is incapable of supplying the low frequency starting at the phase of 0°, it is then preferable to supply the low frequency for 1.5 cycles.

In the case of a high-pressure discharge lamp of a DC current type, the following arrangement may be made. That is, if the current across the electrodes is below a predetermined level due to the change in the interelectrode distance during the lamp operation, the DC current is supplied for the time period in the reversed flow direction with respect to the rated direction. Similarly to the AC current type, this is because it is the protrusion formed on the electrode in negative phase (i.e., the cathode) that abnormally grows. Reversing the current flow leads to that the temperature at the tip of the electrode rises, so that the abnormally grown protrusion may disappear partly. The rated direction refers to the direction of the DC current that flows from the electrode prepared for anode to the electrode prepared for cathode.

Here, it may be applicable to provide the above time period when the high-pressure discharge lamp is operated at the lower power than the rated power. As already described above, the operation of the lamp at the lower lamp voltage Vla tends to result in the abnormal growth of the protrusions. However, even when the lamp is operated at the rated power, there still is a possibility that the protrusions grow for some reason. Thus, it may be preferable to provide the above time period if the current across the electrodes decreases below the predetermined value regardless of whether the lamp is operated at the rated power.

(3) Construction of Lighting Apparatus

Figure 4:
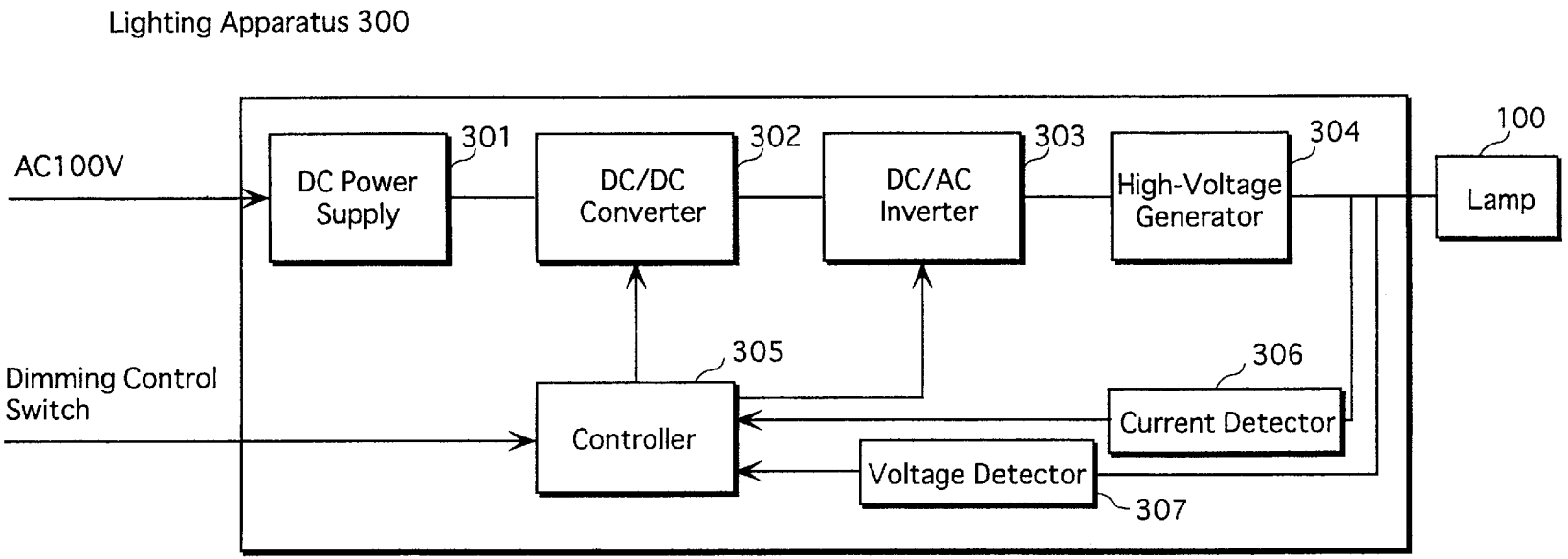
FIG. 4 is a block diagram showing the construction of a lighting apparatus 300.

Next, description is given concretely to the construction of a lighting apparatus that includes a lighting circuit for implementing the operating method according to the present invention. FIG. 4 is a block diagram showing the construction of a lighting apparatus (ballast) 300 according to this embodiment. As shown in the figure, the lighting apparatus 300 is composed of a DC power supply 301, a DC/DC converter 302, a DC/AC inverter 303, a high-voltage generator 304, a controller 305, a current detector 306, and a voltage detector 307.

The DC power supply 301 includes e.g. a rectifier circuit, and generates a DC voltage from a home use 100V AC. Under the control of the controller 305 composed of a micro computer, the DC/DC converter 302 supplies to the DC/AC inverter 303 a DC at a predetermined voltage. Under the control of the controller 305, the DC/AC inverter 303 generates an AC square wave current at a predetermined frequency, and supplies the AC to the high-voltage generator 304. The high-voltage generator 304 includes e.g. a transformer, and high voltage generated within the high-voltage generator 304 is applied to the high-pressure mercury lamp 100.

When breakdown occurs between the electrodes of the high-pressure mercury lamp 100, an arc discharge current begins to flow across the electrodes. In response, the current detector 306 sends a detection signal to the controller 305, so that a lighting detection unit provided within the controller 305 recognizes that the "lamp operation has started". After the "lamp operation has started", the controller 305 sends a signal to the DC/DC converter 302 based on detection signals of both the current detector 306 and the voltage detector 307 that detects the lamp voltage Vla, so that the lighting power of the lamp is controlled. The control performed in the above manner is a constant-power control that is based on the current detected by the current detector 306 and the voltage detected by the voltage detector 307. To be more specific, the controller 305 compares the product of the detected current and the detected voltage with a reference power stored in its internal memory so as to control the DC/DC converter 302 to output a current that results in the constant power. The controller 305 is connected to a switch that is provided outside the lighting apparatus, and operations for dimming control are inputted through the switch. In response to the operations for dimming control, the reference power is varied so as to perform the dimming control.

The internal memory of the controller 305 stores, besides the reference power, a reference lamp voltage used to detect abnormal growth of the tip of the electrodes. The controller 305 judges that there is a protrusion abnormally grown when the lamp voltage Vla detected by the voltage detector 307 is below the reference lamp voltage. Upon making such a judgment, the controller 305 sends a signal to the DC/AC inverter 303 so that the frequency of the current passing through the lighting circuit is made lower than the rated frequency for the duration of a predetermined time period. The control performed in this manner is hereinafter referred to as "low-frequency supplying control". The details of the control are described later.

(4) Findings Regarding State of Electrode Tips

Hereinafter, description is given to findings from the study regarding the impact of dimming control on the high-pressure mercury lamp 100 and the lighting apparatus 300, especially on the electrode tips.

First, description is given briefly to the construction of the electrode 102 (as well as of the electrode 103) according to this embodiment. The electrode 102 used in the high-pressure mercury lamp 100 according to this embodiment is obtained as follows. With reference to FIG. 3, an electrode rod 121 made of tungsten is provided with a coil 123 made of a thin tungsten wire wound around at a tip of the electrode rod 121. The tip portion of the electrode rod 121 and the coil 123 are partly melted and processed to form a hemispherical electrode tip 122. Thereafter, the lamp is operated for a predetermined duration by supplying an alternating current at a predetermined frequency (i.e., by aging), so that the tip portion has a protrusion of an appropriate size.

The inventors of the present invention have made the following first attempt. That is, regardless of the detected value of the lamp voltage Vla, the dimming control is effected while the frequency of the lighting current is kept constant. As a result, as shown in FIG. 3, there is a protrusion 124 abnormally grown at the electrode tip 122. A protrusion of a suitable size present at the electrode tip is preferable in order to suppress a so-called arc jumping phenomenon (the phenomenon that the point from which discharge arc occurs across the electrodes unstably moves around the middle and periphery of each electrode tip) that is likely to cause grate fluctuation in illuminance. Yet, such an abnormally grown protrusion as shown in FIG. 4 makes the interelectrode distance shorter, which causes the lamp voltage Vla to decrease.

The decrease in the lamp voltage Vla due to the abnormally grown protrusions results in increase in the power supplied to the lamp, i.e., in the output current of the DC/DC converter 302. This increase is concluded as the cause of the excessive temperature rise in the lighting apparatus 300. In view of the above, the inventors of the present invention have conducted extensive study on a method for operating the lamp while keeping each protrusion at an appropriate size, and have arrived at the concept that the low-frequency supplying control according to the present invention is effective.

To be more specific, to keep the protrusion 124 within a suitable size, when the protrusion 124 is abnormally grown, it is preferable to temporarily raise the temperature of the electrode tips so as to evaporate some of the tungsten forming the protrusion 124. However, it is undesirable to vary the power supply to the lamp for the purpose of raising the temperature of the electrode tips because variation in the power supply immediately results in illuminance fluctuation. This is undesirable especially in the case of the lamp used as a light source for a liquid crystal projector. Yet, there is another arrangement to raise the temperature of the electrode tips. That is, by lowering the frequency of lightning current to the state almost similar to that of a DC, the temperature of the electrode tip is expected to rise. Thus, when the protrusion 124 abnormally grows, the frequency of lighting current is lowered, so that the protrusion 124 is kept within an appropriate size without varying the supplying power, and thus without causing much fluctuation in illuminance.

Yet, it is noted that at the time of performing low-frequency supplying control, supplying a low frequency current at a specific frequency or for a specific number of cycles may cause non-negligible flickering of the lamp due to various factors, such as the reveres in the current flow passing across the electrodes. Thus, care should be taken in determining the frequency and the number of cycles of the low frequency current to be supplied. Hereinafter, concrete description is given sequentially to the details of the control performed by the controller 305, the frequency, and the supplying cycles as have been studied by the inventors of the present invention.

(5) Control Performed by Controller 305

Figure 5:
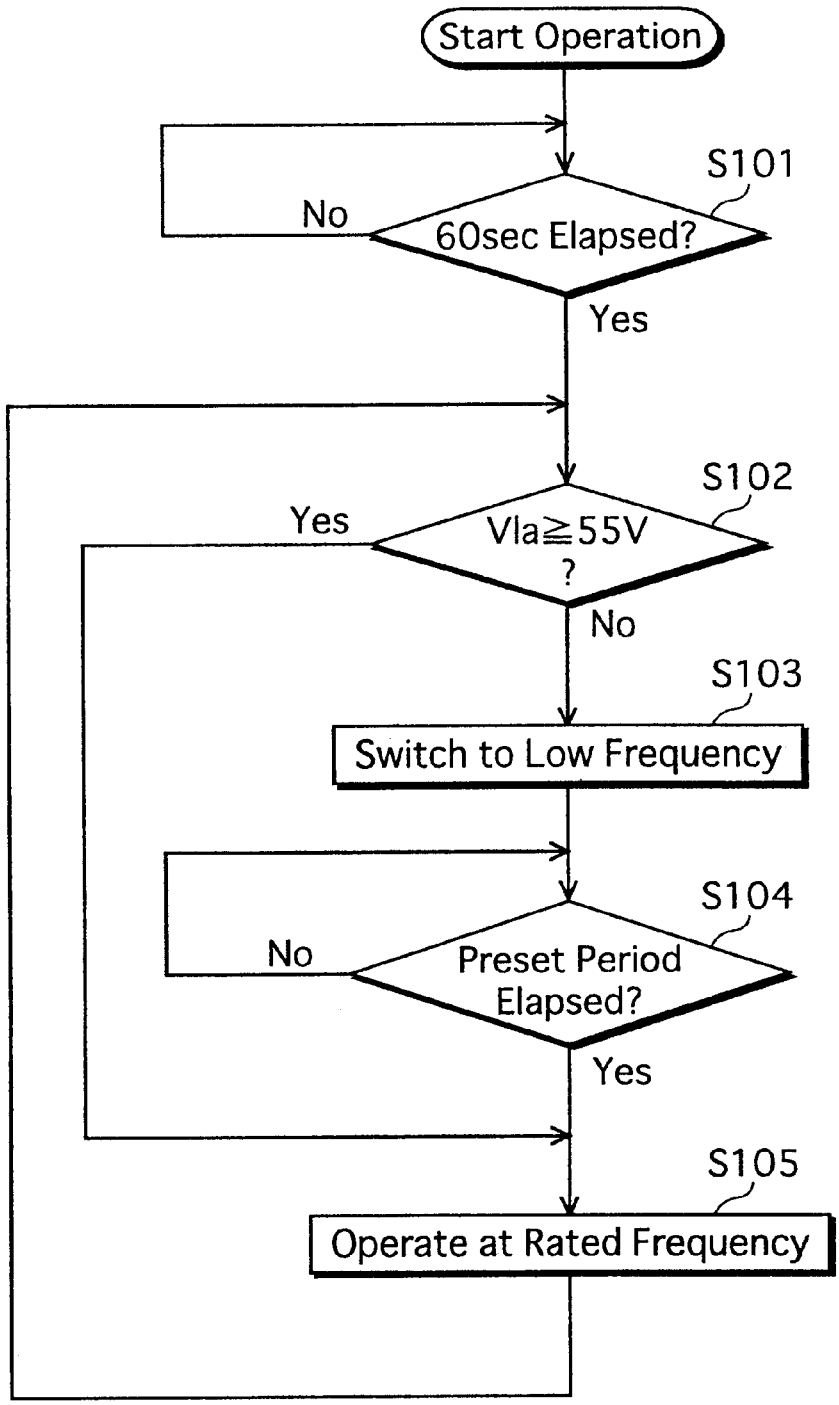
FIG. 5 is a flowchart showing operations performed by a controller 305 for low-frequency supplying control.

First, concrete description is given to the control performed by the controller 305 according to this embodiment. FIG. 5 is a flowchart showing one example of a series of operations performed by the controller 305. First, the controller 305 of this embodiment judges with the use of its internal timer whether 60 seconds have elapsed since the turn-on of the high-pressure mercury lamp 100 (S101). Here, the reference time for the judgment is determined to be "60 seconds". This is because in the case of the high-pressure mercury lamp 100 with the rated power of 150 W as described above, it usually takes 60 seconds or so after turning on the lamp before the discharge stabilizes. Thus, it is preferable to optimize the reference time for the judgment depending on the specifications of the lamp such as the rated power.

In this embodiment, the protrusion 124 is assumed to be abnormally grown if the lamp voltage Vla detected by the voltage detector 307 is lower than a predetermined reference voltage. In such a case, to suitably evaporate the tungsten forming the abnormally grown protrusion 124, the frequency of current supplied is temporarily converted to a low frequency. However, it is undesirable to supply a low frequency current simply because the lamp voltage Vla is below the predetermined value regardless of whether it is immediately after the lamp is operated, i.e. before the discharge stabilizes. Such an operation may possibly end up with completely evaporating a protrusion of a suitable size although the protrusion is effective to suppress the arc jump phenomenon. Accordingly, the low-frequency supplying control is not performed until the discharge stabilizes.

After a lapse of 60 seconds (S101: Yes), the controller 305 judges whether the lamp voltage Vla detected by the voltage detector 307 is below the reference voltage of 55V (S102). When judging that Vla is below the reference voltage (step S102: No), the controller 305 controls the DC/AC inverter 303 so as to output the AC square wave current at a low frequency, thereby performing the low-frequency supplying control (S103). Here, the reference voltage is set at 55V, yet this value is shown merely as an example and not to limit the reference voltage to this specific value. Further, it goes without saying that it is preferable to optimize the reference voltage depending on specifications of the lamp such as the rated power.

Figure 6:
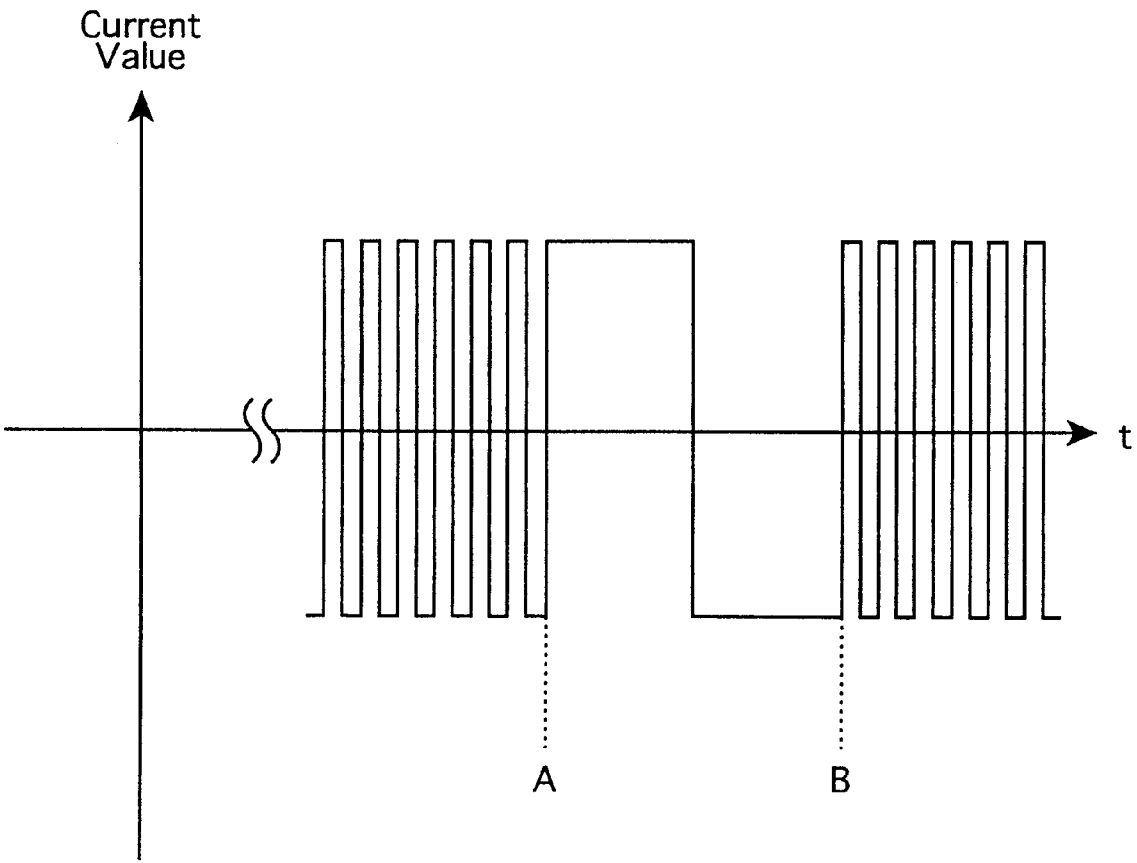
FIG. 6 is a view schematically showing the change in the frequency of an AC square wave current under the low-frequency supplying control.

After a predetermined time period elapses since the low frequency current is supplied (S104: Yes), the lamp is operated at the current of which frequency is put back to the rated frequency (step S105). The predetermined time period is determined mainly depending on the frequency and the number of cycles to be supplied under the low-frequency supplying control. FIG. 6 is a view schematically showing the change in the frequency of the AC square wave current under the low-frequency supplying control. The example shown in the figure is the case using a lighting circuit capable of starting to supply the AC from the phase of 0°. In the example, the rated frequency is 170 Hz and the current is supplied at the frequency of 2 Hz for one cycle between the timing A and the timing B shown in the figure.

As described above, the low frequency current is supplied for at least one cycle, so that protrusions abnormally grown at the tip of the pair of electrodes 102 and 103 disappear equally. Since the protrusions equally disappear, the center of the interelectrode distance remains almost the same, which is desirable in view of suppressing illuminance fluctuation. Yet, supplying the low frequency current for less than one cycle is still effective to reduce the size of the protrusions to some extent. It should be noted that some lighting circuits are unable to switch the frequency at the phase of 0°. In the case where such a lighting circuit is employed, the low frequency current is supplied for 1.5 cycles. With this arrangement, the protrusion abnormally grown at each electrode disappears equally regardless of the phase at which the frequency is switched to low.

(6) Study on Frequency under Low-Frequency Supplying Control

Next, description is given to the study conducted by the inventors of the present invention on the frequency of the AC square wave current supplied under the low-frequency supplying control. FIG. 7 is a view showing the result of actual experiment conducted for the study. In the figure, the frequency (Hz) shows the frequency of the current supplied under the low-frequency supplying control. In each sample, the low frequency current was supplied for 5 cycles.

In the experiment, a test lamp 100 with the rated power of 150 W (the rated voltage of 75V) was illuminated at 120 W for effecting dimming control. The rated frequency of the lamp was 150 Hz. Consistent with the flowchart shown in FIG. 5, the frequency of the current was lowered to the test frequency when the lamp voltage Vla decreased to 55V.

In the figure, the average change in lamp voltage (ΔVla) shows the average of the change in the lamp voltage Vla detected by the voltage detector 307 before and after supplying the low frequency current. In the experiment, five test lamp samples were used for testing each frequency listed in FIG. 7. Thus, the average value was obtained from five measurements of the change in the voltage. The state of electrodes shows the state of electrodes visually checked by the inventors of the present invention.

When supplying the current at the frequency of 0.05 Hz under the low-frequency supplying control, protrusions at the top of each electrode completely disappeared. Thus, there was no protrusion remained, which was determined to be undesirable. When the frequency under the low-frequency supplying control was set at 0.1 Hz, complete disappearance of the protrusions was observed in one sample out of five samples. In the other four samples, however, each protrusion disappeared only partly (suitably remained), and the lamp voltage recovered. Accordingly, it is concluded that the frequency under the low-frequency supplying control is preferably 0.1 Hz or higher.

When the current was supplied at the frequency of 0.5 Hz or 1 Hz, each protrusion remained in a suitable size, and the lamp voltage Vla recovered. When the current was supplied at the frequency of 5 Hz, one sample out of five exhibited no change in the protrusion size and almost no recovery in the lamp voltage Vla. In each of the other four samples, protrusions partly disappeared and the lamp voltage rose. When supplying the current at the frequency of 10 Hz, protrusions partly disappeared in two samples out of five, but no change was observed in the size of the protrusions in the other three samples. At the frequency of 20 Hz, all of the five samples did not exhibit any change in the protrusion size or any recovery in the lamp voltage.

In view of the above experiment, the frequency under the low-frequency supplying control is preferably within the range of 0.1–10 Hz inclusive, and more preferably within the range of 0.1–5 Hz. The frequency within the range of 0.5–1 Hz inclusive is even more preferable. Here, the higher the frequency of the current supplied under the low-frequency supplying control is, the smaller the increase in the lamp voltage Vla is. That is, when the frequency of the low frequency current is rather high, the low-frequency supplying control is required to be performed more often, yet the change in the arc length caused at the time of supplying the low frequency is kept relatively small. Thus, it is preferable to optimally determine the frequency in view of the factors such as the arc length at the rated lamp operation and flicker, which will be described later in detail.

(7) Study on Number of Cycles Supplied Under Low-Frequency Supplying Control

Now, description is given to the study conducted on the number of cycles of the low frequency current to be supplied. FIG. 8 is a view showing the result of actual experiment conducted for the study.

One problem that arises under the low-frequency supplying control is that flicker occurs depending on the frequency or the number of cycles of the low frequency current supplied. Generally, when the frequency is low, the lamp is operated in the state similar to the DC operation. In other words, the arc is out of symmetry. When polarity of each electrode is reversed under such asymmetric arc state, flicker occurs instantly. If the low frequency current is supplied more often, the polarity reverse takes place more often, which inevitably makes occurrence of flicker more notable. Further, the abrupt change in the arc length that occurs when the protrusion disappears may be another factor causing flicker. Theses factors together make occurrences of flicker more notable.

In this experiment, the frequency determined to be suitable in the above experiment was supplied for various cycles to check the change in the lamp voltage Vla and the occurrences of flicker. Similarly to the above experiment, a test lamp having the rated power of 150 W was operated at 120 W for effecting dimming control. The rated frequency was 150 Hz, and the low-frequency supplying control was performed when the lamp voltage Vla decreased to 55V. The frequency switching of the current was performed at the phase of 0°. For each condition, two samples were tested. The flicker column in FIG. 8 shows the result of visual inspection. The mark "○" in the column represents that there was no flicker observed, the mark "Δ" represents that there was not much flicker observed, and the mark "X" represents that flicker was quite notable.

First, description is given to the lamps to which the current was supplied at the frequency of 0.5 Hz under the low-frequency supplying control. When the low frequency current was supplied for 0.5 cycles, no or little flicker was observed. When the low frequency was supplied for 1 cycle, little flicker was observed in both the two samples. When the low frequency was supplied for 5 or more cycles, flicker was quite notable in both the two samples. In view of the above, it is assumed that when the frequency is lower, the asymmetry in arc shape is greater so that its influence is more perceptible. The lamp voltage Vla did not increase much further after the low frequency current was supplied for 1 cycle. Thus, it is concluded that 1 cycle is preferable in order to suppress flicker. Half a cycle is not preferable in view of illuminance fluctuation. It is because supplying the low frequency current for half a cycle causes the temperature rise only in one of the two electrode tips, which possibly causes the arc center to shift.

As described above, there may be a lighting circuit unable to start supplying the low frequency current at the phase of 0°. In the case where such a lighting circuit is employed, supplying the low frequency for 1 cycle may not cause the two protrusions to equally disappear. In that case, the low frequency current is to be supplied for 1.5 cycles.

Now, referring back to the experiment, the frequency under low-frequency supplying control was supplied at 1 Hz. When the low frequency current was supplied for 1 cycle or less, no flicker was observed. When the low frequency was supplied for 5 cycles, little flicker was observed. When the low frequency current was supplied for more than 10 cycles, the flicker was quite notable. In the case of supplying the current at 5 Hz, no flicker was observed up to 5 cycles. When the low frequency current was supplied for 10 cycles, little flicker was observed. When the low frequency current was supplied for 20 cycles or more, the flicker was quite notable.

In view of the above experiment, the number of cycles for which the low frequency is supplied is preferably 10 cycles or less, and more preferably 5 cycles or less. Even more preferable is supplying the low frequency current for 1 cycle starting at the phase of 0°.

(8) Life Tests of Lamps

The low-frequency supplying control may not be considered within the operations which a high-pressure discharge lamp normally performs. Thus, the inventors of the present invention actually conducted life tests on the lamps with which the low-frequency supplying control was performed. Hereinafter, description is given briefly to the test results.

The testing was conducted on the lamp units 200 as shown in FIG. 2 each composed of a lamp having the rated power of 150 W, and the lighting apparatus 300 which in the tests was an electronic ballast in a full bridge configuration that supplies square wave voltage. There were two types of the lamp units, one having a function of the low-frequency supply control, and the other without such a function. Here, the latter type was so constructed to prevent abnormal operations even when the temperature would rise. In the testing, each high-pressure discharge lamp 100 was held horizontally and operated at 120 W for effecting dimming control. The lamp was lit for 3.5 hours and turned off for 0.5 hour, and this cycle was repeated. The testing was conducted in the above manner on five samples with the low-frequency supplying control (the current supplied was switched to 2 Hz for one cycle when the lamp voltage decreased to 55V), and also on another five samples without such control. The life of each sample was judged based on the illuminance maintenance factor after 2000 hours of illumination. In the sample without the low-frequency supplying control, the average of the illuminance maintenance factor was calculated to be 86.3%, while, in the sample with the low-frequency supply control, the average of the illuminance maintenance factor was 85.2%. The results clarify that the low-frequency supplying control had no impact on the life of lamp. Further, with the low-frequency supplying control, there was no sample of which lamp voltage Vla decreased below 55V. Without the low-frequency supplying control, however, 3 samples out of 5 exhibited the lamp voltage Vla below 55V within 500 hours after starting the test. Still further, with the low-frequency supplying control, no flicker was observed throughout the 2000 hours.

<Modifications>

Up to this point, the present invention has been described by way of various embodiments. Yet, it is naturally understood that the present invention is not limited to the specific embodiments disclosed above, and various modifications as shown below are applicable.

(1) The description above is given to the embodiments using, as a high-pressure discharge lamp, the high-pressure mercury lamp of which power rating is 150 W. However, the present invention is not limited to the lamp having a specific power rating, and applicable to other types of lamp. Further, the present invention is not limited to a high-pressure mercy lamp, and applicable to other types of high-pressure discharge lamp, such as a metal halide lamp. This is because as long as a halogen material is enclosed within the arc tube, there is a possibility that a protrusion formed at the tip of each electrode abnormally grows. The low-frequency supplying control resolve the problem of abnormally grown protrusion.

(2) In the embodiments above, instructions for the dimming control are inputted through operating a switch, and the lighting apparatus receives the input. Yet, the dimming control may be effected not by the switch but by signals from a sensor detecting the brightness of the use environment. Alternatively, whether to effect the dimming control may be determined depending on images to be projected.

(3) In the embodiments above, for effecting the dimming control, the reference voltage is switched to another value also stored in the internal memory of the controller 305. Yet, the reference value may be fixed, and the detection performed by the voltage detector 307 maybe varied instead. It goes without saying that the power to be supplied under dimming control is not limited to 120 W.

(4) In the above embodiments, the description is given to the illumination method by supplying an AC square wave current. Yet, a DC-type, high-pressure discharge lamp may also suffer from the problem of the decrease in the lamp voltage Vla caused by a protrusion abnormally grown at the tip of one of the electrodes (the cathode). This problem is solved by temporarily reversing the flow direction of DC for a predetermined period, whereby a part of the protrusion disappears.

(5) In the embodiments above, the frequency at the time of low-frequency supplying control is kept constant. Yet, there may be a case where abrupt disappearance of the protrusion may results in abrupt change in the arc length, which causes the fluctuation in the lamp illuminance. In order for preventing such abrupt change in the arc length, the frequency of the current may be gradually lowered during the low-frequency supplying control. To be more specific, for example, when the lamp voltage decreases below the predetermined reference, the frequency of the current may by lowed in stepwise as follows. That is, the voltage is sequentially lowered to 10 Hz (for 1 cycle), to 8 Hz (for 1 cycle), to 6 Hz (for 1 cycle), to 4 Hz (for 1 cycle), and finally to 2 Hz (for 1 cycle).

(6) In the above embodiments, the low frequency under the low-frequency supplying control is supplied continuously (see S104 in FIG. 5). Yet, the low frequency current may be intermittently supplied during a predetermined time period.

(7) In the embodiments above, the electrode 102 has the domical electrode tip 122, but the shape of the electrode is not limited thereto. The present invention is also applicable to an electrode formed by simply winding a coil around an electrode rod, or an electrode formed by attaching a tubular member to an electrode rod in a manner to cover the tip of the electrode rod. As long as a halogen material is enclosed within the arc tube and the halogen cycle is utilized, there is a possibility that the electrode material accumulates at the tip of each electrode regardless of the structure of the electrode.

(8) In the above embodiments, the controller 305 is implemented by a microcomputer. However, besides a lighting circuit using a microcomputer, there are other types of lighting circuit widely in use. One example is a lighting circuit made up of variety of circuits in combination as disclosed in JP 5-67496-A or JP 5-144577-A (hereinafter such a lighting circuit is referred to as "analog lighting circuit".

The present invention is also applicable to such an analog circuit as above. In order to embody the present invention with such an analog circuit, the analog circuit needs to incorporated therein various circuits such as a circuit for detecting a lamp voltage exceeding a predetermined value, a switching circuit for supplying a low frequency current, and a circuit for measuring supplying cycles. Yet, the need for providing the above circuits maybe met in the following manner. The time (cycle) measurement is provided by adjusting a time constant of a time constant circuit, such as a CR circuit, or by using a counter. The switching may be done with the use of a selector. Further, the detection of the lamp voltage exceeding a predetermined reference voltage may be performed with the use of a comparator circuit comparing the lamp voltage with the reference voltage.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A method for operating a high-pressure discharge lamp by supplying an alternating current thereto, the high-pressure discharge lamp having an arc tube in which a halogen material is sealed and a pair of electrodes is provided, the method comprising:

a voltage decrease detecting step of detecting that a voltage across the pair of electrodes has decreased below a predetermined level; and a low frequency current supplying step of supplying the alternating current at a lower frequency than a rated frequency for a predetermined time period, the low frequency current supplying step being performed when the voltage decrease is detected in the voltage decrease detecting step.

2. The method for operating a high-pressure discharge lamp of claim 1, wherein the frequency of alternating current during the time period is within a range of 0.1 Hz and 10 Hz inclusive.

3. The method for operating a high-pressure discharge lamp of claim 1, wherein the duration of the time period corresponds to ten cycles or less of the alternating current.

4. The method for operating a high-pressure discharge lamp of claim 1, wherein the duration of the time period corresponds to one cycle or more of the alternating current.

5. The method for operating a high-pressure discharge lamp of claim 1, wherein the duration of the time period corresponds to one and a half cycles of the alternating current.

6. The method for operating a high-pressure discharge lamp of claim 1, wherein the alternating current is supplied at the lower frequency when the high-pressure discharge lamp is operated at a lower power than a rated power.

7. A method for operating a high-pressure discharge lamp by supplying a direct current thereto, the high-pressure discharge lamp having an arc tube in which a halogen material is sealed and a pair of electrodes is provided, the method comprising:

a voltage decrease detecting step of detecting that a voltage across the pair of electrodes has decreased below a predetermined level; and a current-direction reversing step of reversing a direction of the direct current for a predetermined time period, the current-direction reversing step being performed when the voltage decrease is detected in the voltage decrease detecting step.

8. The method for operating a high-pressure discharge lamp of claim 7, wherein the direct current is reversed when the high-pressure discharge lamp is operated at a lower power than a rated power.

9. A lighting apparatus for operating a high-pressure discharge lamp by supplying an alternative current thereto, the high-pressure discharge lamp having an arc tube in which a halogen material is sealed and a pair of electrodes is provided, comprising:

a voltage detector for detecting a voltage across the pair of electrodes; and a controller for controlling the alternating current so that, when the voltage detected by the voltage detector decreases below a predetermined level, the alternating current is supplied at a lower frequency than a rated frequency for a predetermined time period.

10. The lighting apparatus of claim 9, wherein the frequency of alternating current during the time period is within a range of 0.1 Hz and 10 Hz inclusive.

11. The lighting apparatus of claim 9, wherein the duration of the time period corresponds to ten cycles or less of the alternating current.

12. The lighting apparatus of claim 9, wherein the duration of the time period corresponds to one cycle or more of the alternating current.

13. The lighting apparatus of claim 9, wherein the duration of the time period corresponds to one and a half cycles of the alternating current.

14. The lighting apparatus of claim 9, wherein the controller starts the control after a predetermined time is elapsed since the high-pressure discharge lamp is operated.

15. The lighting apparatus of claim 9, wherein:

the controller further includes a signal input unit for receiving a signal directing to light the high-pressure discharge lamp at a lower power than a rated power; and the controller performs the control when the signal input unit receives the signal.

16. A lighting apparatus for operating a high-pressure discharge lamp by supplying a direct current thereto, the high-pressure discharge lamp having an arc tube in which a halogen material is sealed and a pair of electrodes is provided, comprising:

a voltage detector for detecting a voltage across the pair of electrodes; and a controller for controlling the direct current so that, when the voltage detected by the voltage detector decreases below a predetermined level, the direct current flows in a reversed direction for a predetermined time period.

17. The lighting apparatus of claim 16, wherein the controller starts the control after a predetermined time is elapsed since the high-pressure discharge lamp is operated.

18. The lighting apparatus of claim 16, wherein:

the controller further includes a signal input unit for receiving a signal directing to light the high-pressure discharge lamp at a lower power than a rated power; and the controller performs the control when the signal input unit receives the signal.

19. A high-pressure discharge lamp apparatus comprising:

a socket unit for attaching a high-pressure discharge lamp; and a lighting apparatus for operating the high-pressure discharge lamp by supplying an alternating current thereto in the case when the high-pressure discharge lamp is attached to the socket unit, the high-pressure discharge lamp having an arc tube in which a halogen material is sealed and a pair of electrode is provided, wherein the lighting apparatus includes:

a voltage detector for detecting a voltage across the pair of electrodes; and a controller for controlling the alternating current so that, when the voltage detected by the voltage detector decreases below a predetermined level, the alternating current is supplied at a lower frequency than a rated frequency for a predetermined time period.

20. A high-pressure discharge lamp apparatus comprising:

a socket unit for attaching a high-pressure discharge lamp; and a lighting apparatus for operating the high-pressure discharge lamp by supplying a direct current thereto in the case when the high-pressure discharge lamp is attached to the socket unit, the high-pressure discharge lamp having an arc tube in which a halogen material is sealed and a pair of electrode is provided, wherein the lighting apparatus includes:

a voltage detector for detecting a voltage across the pair of electrodes; and a controller for controlling the direct current so that, when the voltage detected by the voltage detector decreases below a predetermined level, the direct current flows in a reversed direction for a predetermined time period.

21. A high-pressure discharge lamp apparatus comprising:

a high-pressure discharge lamp having an arc tube in which a halogen material is sealed and a pair of electrode is provided; and a lighting apparatus for operating the high-pressure discharge lamp by supplying an alternating current thereto, wherein the lighting apparatus includes:

a voltage detector for detecting a voltage across the pair of electrodes; and a controller for controlling the alternating current so that, when the voltage detected by the voltage detector decreases below a predetermined level, the alternating current is supplied at a lower frequency than a rated frequency for a predetermined time period.

22. The high-pressure discharge lamp apparatus of claim 21, wherein a distance between the pair of electrodes is within a range of 0.5 mm and 2.0 mm inclusive, and a mercury-vapor pressure in the arc tube, when operated at a rated power, is within a range of 15 Mpa and 65 Mpa inclusive.

23. The high-pressure discharge lamp apparatus of claim 21, wherein an amount of the halogen material sealed in the arc tube is within a range of $1\times10^{-9}$ mol/cm$^3$ and $1\times10^{-5}$ mol/cm$^3$ inclusive.

24. The high-pressure discharge lamp apparatus of claim 21, the controller performs the control when the high-pressure voltage lamp is operated at a power lower than a rated power.

25. A high-pressure discharge lamp apparatus comprising:

a high-pressure discharge lamp having an arc tube in which a halogen material is sealed and a pair of electrode is provided; and a lighting apparatus for operating the high-pressure discharge lamp by supplying a direct current thereto, wherein the lighting apparatus includes:

a voltage detector for detecting a voltage across the pair of electrodes; and a controller for controlling the direct current so that, when the voltage detected by the voltage detector decreases below a predetermined level, the direct current flows in a reversed direction for a predetermined time period.

26. The high-pressure discharge lamp apparatus of claim 25, wherein a distance between the pair of electrodes is within a range of 0.5 mm and 2.0 mm inclusive, and a mercury-vapor pressure in the arc tube, when operated at a rated power, is within a range of 15 Mpa and 65 Mpa inclusive.

27. The high-pressure discharge lamp apparatus of claim 25, wherein an amount of the halogen material sealed in the arc tube is within a range of $1\times10^{-9}$ mol/cm$^3$ and $1\times10^{-5}$ mol/cm$^3$ inclusive.

28. The high-pressure discharge lamp apparatus of claim 25, wherein the controller performs the control when the high-pressure voltage lamp is operated at a power lower than a rated power.

* * * * *